US010259029B2

(12) United States Patent
Sakane et al.

(10) Patent No.: US 10,259,029 B2
(45) Date of Patent: Apr. 16, 2019

(54) SPINNING FORMING DEVICE

(71) Applicant: KAWASAKI JUKOGYO KABUSHIKI KAISHA, Kobe-shi, Hyogo (JP)

(72) Inventors: Yuto Sakane, Kobe (JP); Yoshihide Imamura, Kobe (JP); Kohei Mikami, Akashi (JP); Yoshiro Kabe, Kobe (JP); Hayato Iwasaki, Kobe (JP); Hiroshi Kitano, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 55 days.

(21) Appl. No.: 15/303,253

(22) PCT Filed: Apr. 3, 2015

(86) PCT No.: PCT/JP2015/001905
§ 371 (c)(1),
(2) Date: Oct. 11, 2016

(87) PCT Pub. No.: WO2015/155970
PCT Pub. Date: Oct. 15, 2015

(65) Prior Publication Data

US 2017/0036257 A1 Feb. 9, 2017

(30) Foreign Application Priority Data

Apr. 10, 2014 (JP) ..... 2014-080696

(51) Int. Cl.
*B21D 22/14* (2006.01)
*B21D 37/16* (2006.01)

(52) U.S. Cl.
CPC ..... *B21D 22/14* (2013.01); *B21D 37/16* (2013.01)

(58) Field of Classification Search
CPC ..... B21D 22/14; B21D 22/16; B21D 37/16; B21D 53/261; B21D 53/28; H05B 6/102
See application file for complete search history.

(56) References Cited

U.S. PATENT DOCUMENTS

2015/0202677 A1 7/2015 Ogishi et al.

FOREIGN PATENT DOCUMENTS

JP 2011-218427 A 11/2011
JP 2012-066272 A 4/2012
WO 2014/024384 A1 2/2014

OTHER PUBLICATIONS

Jun. 23, 2015 Search Report issued in International Patent Application No. PCT/JP2015/001905.

(Continued)

*Primary Examiner* — Teresa M Ekiert
(74) *Attorney, Agent, or Firm* — Oliff PLC

(57) ABSTRACT

According to a spinning forming device, while a plate is rotated by a rotating shaft, a transform target portion of the plate is pressed by a processing tool and locally heated by a heater that performs induction heating. The heater includes a coil portion having a doubled circular-arc shape and is inclined by an inclining device relative to a direction from the rotating shaft toward the processing tool. A measuring unit measures distances each from the coil portion to an outer peripheral original portion of the plate at a plurality of measurement points distributed in a circumferential direction of the rotating shaft. A controller controls the inclining device based on a measurement result of the measuring unit such that an angle difference between the coil portion and the outer peripheral original portion becomes not more than a predetermined angle.

9 Claims, 7 Drawing Sheets

(56) References Cited

OTHER PUBLICATIONS

Oct. 20, 2016 International Preliminary Report on Patentability issued in International Application No. PCT/ JP2015/001905.

SPINNING FORMING DEVICE

TECHNICAL FIELD

The present invention relates to a spinning forming device for forming a plate in a desired shape while rotating the plate.

BACKGROUND ART

Conventionally known is a spinning forming device designed to transform a plate by pressing a processing tool against the plate while rotating the plate. The spinning forming device normally includes a mandrel (shaping die) attached to a rotating shaft and performs forming in such a manner that the plate is pressed against the mandrel by the processing tool.

In recent years, proposed is a spinning forming device designed to perform spinning forming while locally heating the plate. For example, as a spinning forming device for a titanium alloy, PTL 1 discloses a spinning forming device configured such that a portion (transform target portion) of the plate which is pressed against the mandrel by a spatula (processing tool) is heated by high frequency induction heating.

As a heater suitable for the spinning forming device, the inventors of the present invention have developed a heater including a coil portion extending in a rotational direction of the plate and having a doubled circular-arc shape facing the plate (see PTL 2). By using such a heater, local heating of the transform target portion of the plate can be continuously performed in the rotational direction of the plate. Thus, excellent forming can be realized.

CITATION LIST

Patent Literature

PTL 1: Japanese Laid-Open Patent Application Publication No. 2011-218427

PTL 2: International Publication No. 2014/024384

SUMMARY OF INVENTION

Technical Problem

The inventors of the present invention have newly found in recent studies that when the processing tool is pressed against the transform target portion, an outer peripheral original portion including the transform target portion is inclined in some cases. According to the above heater including the coil portion having the doubled circular-arc shape, the coil portion is parallel to the plate before the processing tool is pressed against the plate. Therefore, if the outer peripheral original portion is inclined, a distance from the coil portion to the outer peripheral original portion becomes nonuniform. Thus, heating by the heater may become inadequate, or the inclined outer peripheral original portion may contact the coil portion of the heater in some cases.

An object of the present invention is to provide a spinning forming device capable of appropriately maintaining a positional relation between an outer peripheral original portion of a plate and a coil portion of a heater even when the outer peripheral original portion is inclined.

Solution to Problem

To solve the above problems, a spinning forming device of the present invention includes: a rotating shaft that rotates a plate to be formed; a processing tool that presses a transform target portion of the plate to transform the plate; a heater that locally heats the transform target portion by induction heating and includes a coil portion extending in a circumferential direction of the rotating shaft and having a doubled circular-arc shape facing the plate; a measuring unit that measures distances each from the coil portion to an outer peripheral original portion of the plate at a plurality of measurement points distributed in the circumferential direction of the rotating shaft, the outer peripheral original portion including the transform target portion; an inclining device that inclines the heater relative to a direction from the rotating shaft toward the processing tool; and a controller that controls the inclining device based on a measurement result of the measuring unit such that an angle difference between the coil portion and the outer peripheral original portion becomes not more than a predetermined angle.

According to the above configuration, the distance from the coil portion of the heater to the outer peripheral original portion of the plate can be kept substantially constant. As a result, even when the outer peripheral original portion is inclined, the positional relation between the outer peripheral original portion and the coil portion can be appropriately maintained.

For example, the spinning forming device may be configured such that: the heater is disposed at a position displaced from a position that is right opposite to the processing tool across the rotating shaft; and the inclining device swings the heater around a swing axis extending in a radial direction of the rotating shaft.

For example, the spinning forming device may be configured such that: the heater is disposed at a position that is right opposite to the processing tool across the rotating shaft; and the inclining device swings the heater around a swing axis extending in a direction orthogonal to a radial direction of the rotating shaft.

For example, the spinning forming device may be configured such that the controller controls the inclining device such that an absolute value of a difference between the distances measured at the plurality of measurement points becomes not more than a threshold.

For example, the spinning forming device may be configured such that the measuring unit includes a plurality of distance sensors disposed so as to be spaced apart from one another in the circumferential direction of the rotating shaft.

For example, the spinning forming device may be configured such that the heater is at least one of a rear-side heater disposed at an opposite side of the processing tool across the plate and a front-side heater disposed at a same side as the processing tool relative to the plate.

The spinning forming device may further includes a heat station to which the heater is coupled and in which an AC power supply circuit is formed, wherein the inclining device may incline the heater through the heat station. According to this configuration, since the heater is inclined together with the heat station, the heater can be strongly held by the heat station. As a result, even if a high current flows through the coil portion of the heater, and a high attractive force and a high repulsive force act on the heater, deformation of the heater can be suppressed.

The spinning forming device may further include a receiving jig attached to the rotating shaft and supporting a central portion of the plate. For example, it is presumed that when the mandrel is used, the inclination of the outer peripheral original portion of the plate is caused mainly by elastic deformation of the plate. On the other hand, when the receiving jig is used instead of the mandrel, an overhanging portion of the plate which portion overhangs from the receiving jig (i.e., a portion other than the central portion supported by the receiving jig) becomes a cantilever, so that the inclination of the outer peripheral original portion of the plate becomes larger by deflection of the overhanging portion. Therefore, when such receiving jig is used, the effects of the present invention can be remarkably obtained.

Advantageous Effects of Invention

According to the present invention, even when the outer peripheral original portion of the plate is inclined, the positional relation between the outer peripheral original portion and the coil portion of the heater can be appropriately maintained.

DESCRIPTION OF EMBODIMENTS

Figure 1:
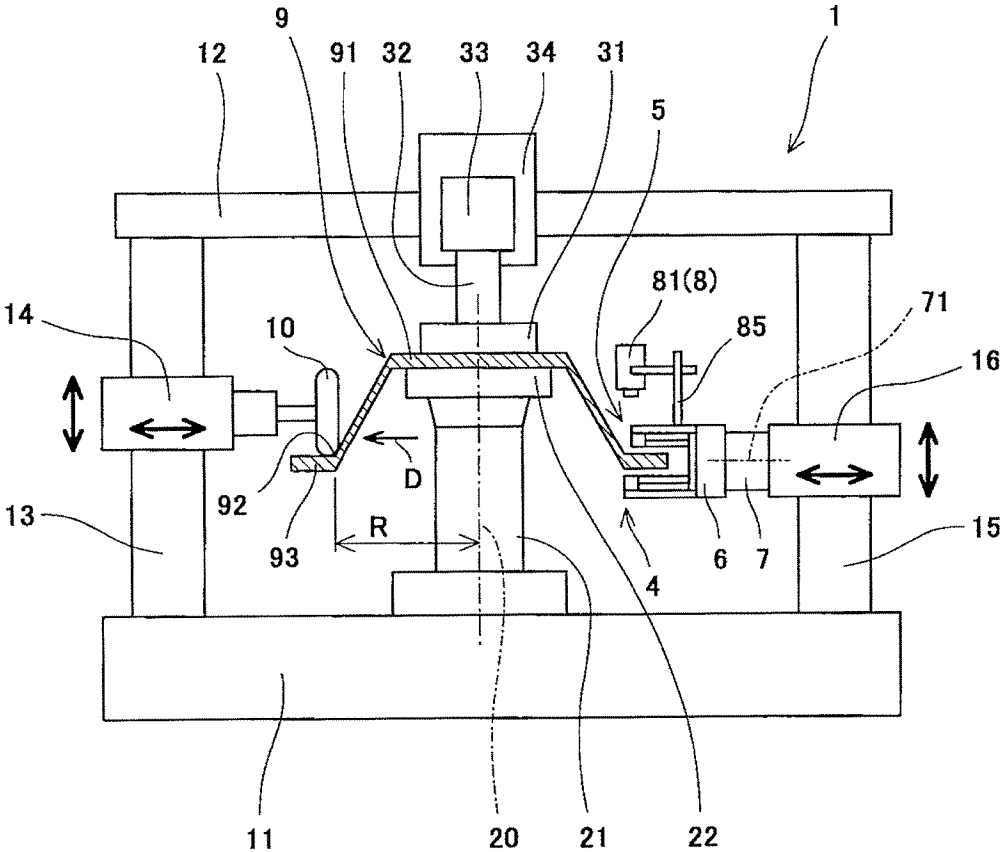
FIG. 1 is a schematic configuration diagram showing a spinning forming device according to one embodiment of the present invention.

FIG. 1 shows a spinning forming device 1 according to one embodiment of the present invention. The spinning forming device 1 includes: a rotating shaft 21 that rotates a plate 9 to be formed; a receiving jig 22 interposed between the rotating shaft 21 and the plate 9; and a fixing jig 31. The receiving jig 22 is attached to the rotating shaft 21 and supports a central portion 91 of the plate 9. The fixing jig 31 sandwiches the plate 9 together with the receiving jig 22. The spinning forming device 1 further includes: a rear-side heater 4 and a front-side heater 5 each of which locally heats a transform target portion 92 of the plate 9 by induction heating, the transform target portion 92 being located away from a center axis 20 of the rotating shaft 21 by a predetermined distance R; and a processing tool 10 that presses the transform target portion 92 to transform the plate 9.

An axial direction of the rotating shaft 21 (i.e., a direction in which the center axis 20 extends) is a vertical direction in the present embodiment. However, the axial direction of the rotating shaft 21 may be a horizontal direction or an oblique direction. A lower portion of the rotating shaft 21 is supported by a base 11. The rotating shaft 21 is rotated by a motor, not shown. An upper surface of the rotating shaft 21 is flat, and the receiving jig 22 is fixed to the upper surface of the rotating shaft 21.

The plate 9 is, for example, a flat circular plate. However, the shape of the plate 9 may be a polygonal shape or an oval shape. The plate 9 is not necessarily flat over the entirety. For example, the central portion 91 of the plate 9 may be thicker than a peripheral edge portion of the plate 9, or the entire plate 9 or a part of the plate 9 may be processed in advance to have a tapered shape. A material of the plate 9 is not especially limited and is, for example, a titanium alloy.

The receiving jig 22 has a size within a circle defined by a forming start position of the plate 9. For example, in a case where the receiving jig 22 has a disc shape, a diameter of the receiving jig 22 is equal to or smaller than a diameter of the circle defined by the forming start position of the plate 9. Unlike conventional mandrels, the plate 9 is not transformed by being pressed against a radially outer side surface of the receiving jig 22.

The fixing jig 31 is attached to a pressurizing rod 32. The pressurizing rod 32 is rotatably supported by a supporting portion 33. The supporting portion 33 is driven by a driving portion 34 in an upward/downward direction. The driving portion 34 is attached to a frame 12 disposed above the rotating shaft 21. It should be noted that the fixing jig 31 may be omitted, and the plate 9 may be directly fixed to the receiving jig 22 by, for example, bolts.

In the present embodiment, the processing tool 10 that presses the transform target portion 92 of the plate 9 is disposed above the plate 9, and the plate 9 is processed by the processing tool 10 in a downwardly opening shape that accommodates the receiving jig 22. To be specific, an upper surface of the plate 9 is a front surface, and a lower surface of the plate 9 is a rear surface. However, the processing tool 10 may be disposed under the plate 9, and the plate 9 may be processed by the processing tool 10 in an upwardly opening shape that accommodates the fixing jig 31. To be specific, the lower surface of the plate 9 may be the front surface, and the upper surface of the plate 9 may be the rear surface.

The processing tool 10 is moved by a first radial direction movement mechanism 14 in a radial direction of the rotating shaft 21 and is also moved by a first axial direction movement mechanism 13 through the first radial direction movement mechanism 14 in the axial direction of the rotating shaft 21. The first axial direction movement mechanism 13 extends so as to couple the base 11 and the frame 12. In the present embodiment, used as the processing tool 10 is a roller that follows the rotation of the plate 9 to rotate. However, the processing tool 10 is not limited to the roller and may be, for example, a spatula.

The rear-side heater 4 is disposed at an opposite side of the processing tool 10 across the plate 9, and the front-side heater 5 is disposed at the same side as the processing tool 10 relative to the plate 9. In the present embodiment, the rear-side heater 4 and the front-side heater 5 are coupled to a common heat station 6. The rear-side heater 4 and the front-side heater 5 face each other in the axial direction of the rotating shaft 21. The heat station 6 is disposed outside the heaters 4 and 5 in the radial direction of the rotating shaft 21.

The rear-side heater 4 and the front-side heater 5 are moved by a second radial direction movement mechanism 16 through the heat station 6 in the radial direction of the rotating shaft 21 and are also moved by a second axial direction movement mechanism 15 through the heat station 6 and the second radial direction movement mechanism 16 in the axial direction of the rotating shaft 21. The second axial direction movement mechanism 15 extends so as to couple the base 11 and the frame 12.

Figure 3:
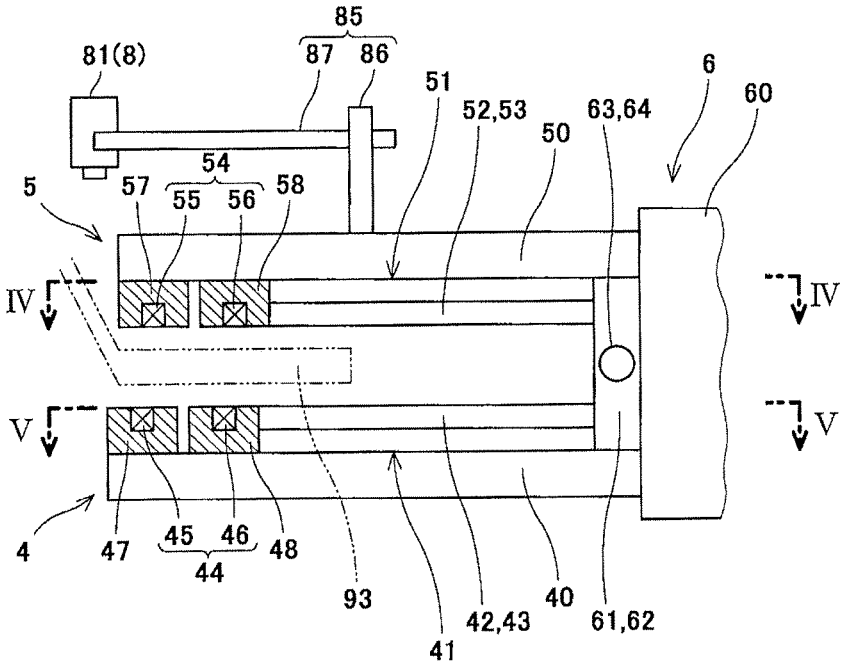
FIG. 3 is a cross-sectional side view showing a front-side heater, a rear-side heater, and a heat station in the spinning forming device shown in FIG. 1.
Figure 4:
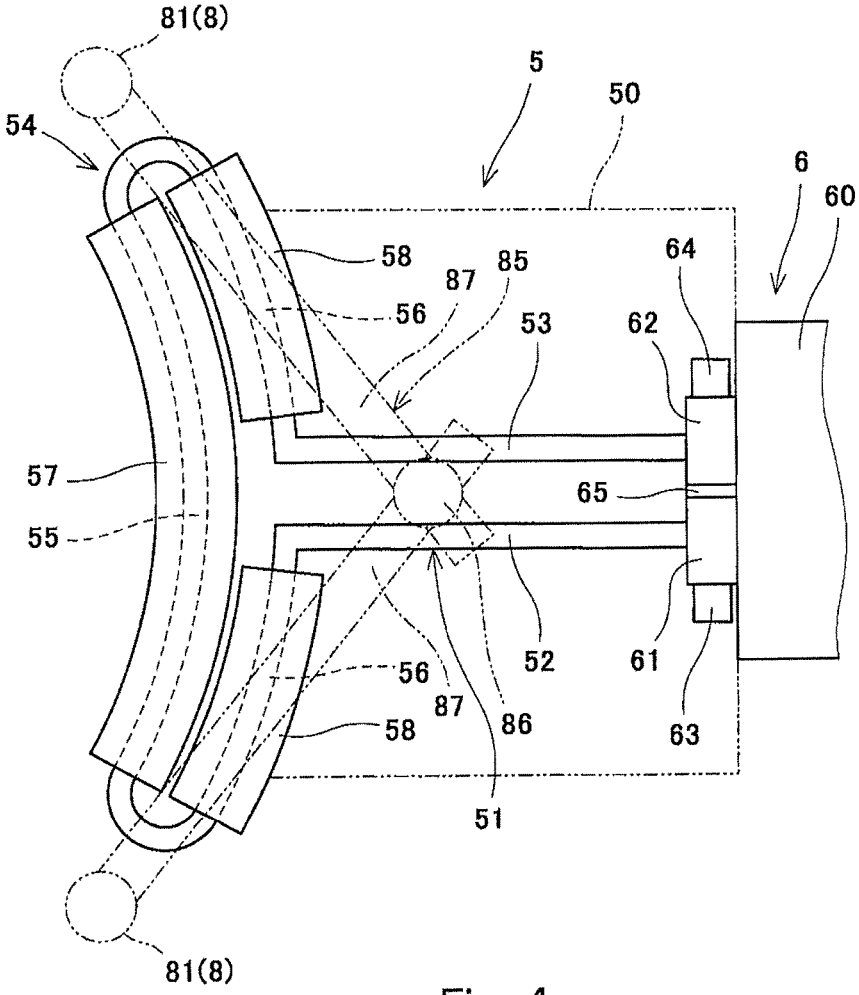
FIG. 4 is a plan view showing the front-side heater and the heat station when viewed from a position indicated by line IV-IV of FIG. 3.
Figure 5:
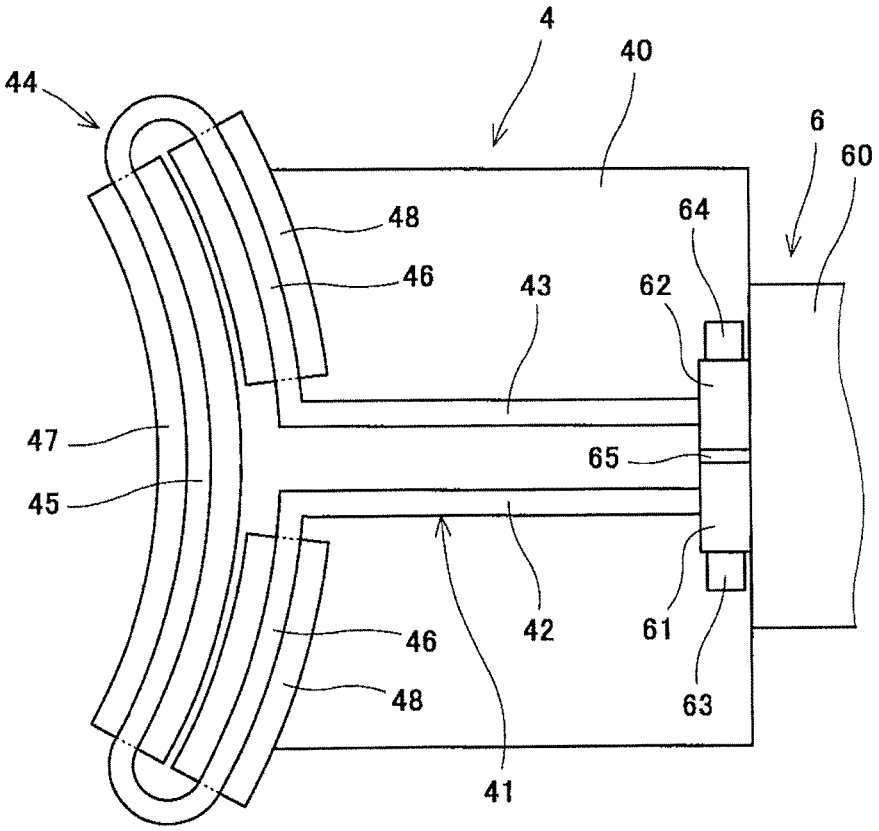
FIG. 5 is a plan view showing the rear-side heater and the heat station when viewed from a position indicated by line V-V of FIG. 3.

As shown in FIGS. 3 to 5, the heat station 6 includes a box-shaped main body 60 and a pair of connection boxes 61 and 62 fixed to a side surface of the main body 60, the side surface facing the rotating shaft 21. An AC power supply circuit for applying a voltage to a below-described electric conducting pipe 41 of the rear-side heater 4 and a below-described electric conducting pipe 51 of the front-side heater 5 is formed in the main body 60. The connection boxes 61 and 62 are constituted by electrically-conductive members and are located adjacent to each other with an insulating plate 65 interposed therebetween. The connection boxes 61 and 62 are electrically connected to the power supply circuit provided in the main body 60. In the present embodiment, each of the connection boxes 61 and 62 extends in the vertical direction so as to be a crosslink between the front-side heater 5 and the rear-side heater 4.

The connection boxes 61 and 62 are electrically connected to each other through the electric conducting pipe 41 of the rear-side heater 4 and the electric conducting pipe 51 of the front-side heater 5. To be specific, an alternating current flows from one of the connection boxes 61 and 62 to the other through the electric conducting pipes 51 and 41. A frequency of the alternating current is not especially limited but is desirably a high frequency of 5 k to 400 kHz. To be specific, the induction heating performed by the rear-side heater 4 and the front-side heater 5 is desirably high frequency induction heating.

The connection boxes 61 and 62 are provided with cooling liquid ports 63 and 64, respectively. A cooling liquid is supplied to one of the connection boxes 61 and 62 through the cooling liquid port (63 or 64) and circulates through the electric conducting pipes 51 and 41. After that, the cooling liquid is discharged from an inside of the other of the connection boxes 61 and 62 through the cooling liquid port (64 or 63). By this circulation of the cooling liquid through the electric conducting pipes 51 and 41, a large current (such as 1,000 to 4,000 A) can flow through the electric conducting pipes 51 and 41.

As shown in FIGS. 3 and 5, the rear-side heater 4 includes: the electric conducting pipe 41 in which the cooling liquid flows; and a supporting plate 40. A cross-sectional shape of the electric conducting pipe 41 is a square shape in the present embodiment but may be any other shape (such as a circular shape). The supporting plate 40 is made of, for example, a thermal-resistant material (such as a ceramic fiber-based material) and supports the electric conducting pipe 41 through an insulating member, not shown. The supporting plate 40 is fixed to the main body 60 of the heat station 6 through an insulating member, not shown. It should be noted that the supporting plate 40 may be made of insulating resin. In this case, the supporting plate 40 may directly support the electric conducting pipe 41 and may be directly fixed to the main body 60 of the heat station 6.

The electric conducting pipe 41 includes a coil portion 44 and a pair of lead portions 42 and 43. The coil portion 44 extends in a circumferential direction of the rotating shaft 21 and has a doubled circular-arc shape facing the plate 9. The lead portions 42 and 43 extend from a middle of the coil portion 44 outward in the radial direction of the rotating shaft 21. To be specific, the coil portion 44 includes one inner circular-arc portion 45 and two outer circular-arc portions 46 spreading at both sides of the lead portions 42 and 43. An opening angle (angle between both end portions) of the coil portion 44 is, for example, 60° to 120°. The lead portions 42 and 43 are connected to the connection boxes 61 and 62 of the heat station 6, respectively.

The rear-side heater 4 also includes one first core 47 and two second cores 48. The first core 47 covers the inner circular-arc portion 45 of the coil portion 44 from an opposite side of the plate 9. The second cores 48 cover the outer circular-arc portions 46 from the opposite side of the plate 9. The first core 47 is intended to collect magnetic flux generated around the inner circular-arc portion 45, and the second cores 48 are intended to collect magnetic flux generated around the outer circular-arc portions 46. The first core 47 and the second cores 48 are supported by the supporting plate 40 through an insulating member, not shown.

As shown in FIGS. 3 and 4, the front-side heater 5 includes: the electric conducting pipe 51 in which the cooling liquid flows; and a supporting plate 50. A cross-sectional shape of the electric conducting pipe 51 is a square shape in the present embodiment but may be any other shape (such as a circular shape). The supporting plate 50 is made of, for example, a thermal-resistant material (such as a ceramic fiber-based material) and supports the electric conducting pipe 51 through an insulating member, not shown. The supporting plate 50 is fixed to the main body 60 of the heat station 6 through an insulating member, not shown. It should be noted that the supporting plate 50 may be made of insulating resin. In this case, the supporting plate 50 may directly support the electric conducting pipe 51 and may be directly fixed to the main body 60 of the heat station 6.

The electric conducting pipe 51 includes a coil portion 54 and a pair of lead portions 52 and 53. The coil portion 54 extends in the circumferential direction of the rotating shaft 21 and has a doubled circular-arc shape facing the plate 9. The lead portions 52 and 53 extend from a middle of the coil portion 54 outward in the radial direction of the rotating shaft 21. To be specific, the coil portion 54 includes one inner circular-arc portion 55 and two outer circular-arc portions 56 spreading at both sides of the lead portions 52 and 53. An opening angle (angle between both end portions) of the coil portion 54 is, for example, 60° to 120°. The lead portions 52 and 53 are connected to the connection boxes 61 and 62 of the heat station 6, respectively. To be specific, the electric conducting pipe 51 of the front-side heater 5 is connected to the connection boxes 61 and 62 in parallel with the electric conducting pipe 41 of the rear-side heater 4. However, the electric conducting pipe 51 may be connected to the connection boxes 61 and 62 in series with the electric conducting pipe 41.

The front-side heater 5 also includes one first core 57 and two second cores 58. The first core 57 covers the inner circular-arc portion 55 of the coil portion 54 from the opposite side of the plate 9. The second cores 58 cover the outer circular-arc portions 56 from the opposite side of the plate 9. The first core 57 is intended to collect magnetic flux generated around the inner circular-arc portion 55, and the second cores 58 are intended to collect magnetic flux generated around the outer circular-arc portions 56. The first core 57 and the second cores 58 are supported by the supporting plate 50 through an insulating member, not shown.

The relative positions of the heaters 4 and 5 and the processing tool 10 are not especially limited as long as they are located on substantially the same circumference around the center axis 20 of the rotating shaft 21. As shown in FIG.

6A, in the present embodiment, each of the rear-side heater 4 and the front-side heater 5 is disposed at a position displaced from a position that is right opposite to the processing tool 10 across the rotating shaft 21 (for example, each of the rear-side heater 4 and the front-side heater 5 is disposed at such a position that an angle between a center of the rear-side heater 4 or the front-side heater 5 and a center of the processing tool 10 when viewed from the center axis 20 of the rotating shaft 21 is about 120 degrees). In FIG. 1, to facilitate understanding of the configuration of the spinning forming device 1, each of the heaters 4 and 5 is drawn at the position that is right opposite to the processing tool 10 across the rotating shaft 21. However, the correct positions of the heaters 4 and 5 are shown in FIG. 6A.

Referring back to FIG. 1, an inclining device 7 that inclines the heaters 4 and 5 through the heat station 6 is provided between the heat station 6 to which the rear-side heater 4 and the front-side heater 5 are coupled and the second radial direction movement mechanism 16. The inclining device 7 inclines the heaters 4 and 5 relative to a direction D from the rotating shaft 21 toward the processing tool 10 (i.e., one direction along the radial direction of the rotating shaft 21). In other words, the heaters 4 and 5 are inclined so as to become substantially parallel to a virtual inclined surface intersecting with a reference surface on a straight line orthogonal to the direction D, the reference surface being orthogonal to the axial direction of the rotating shaft 21.

Figure 6A:
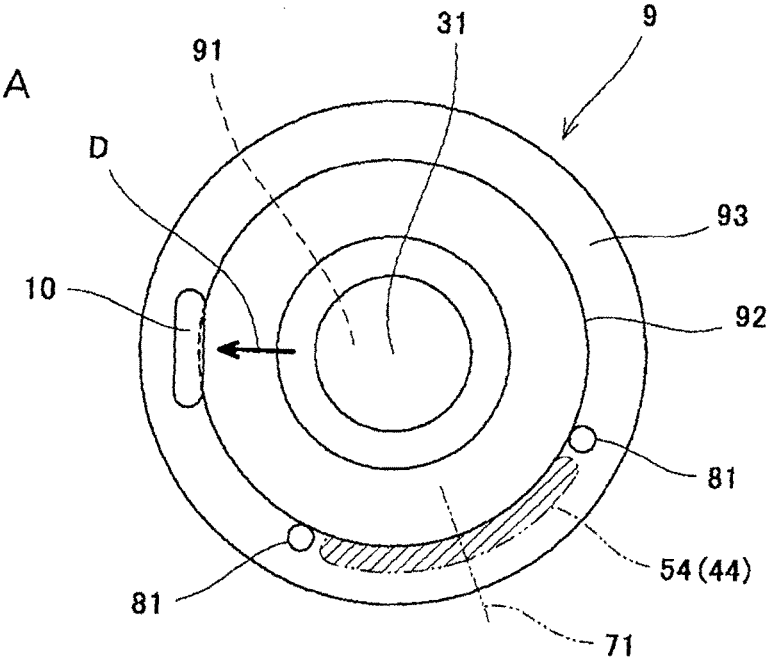
FIG. 6A is a plan view of a plate in the middle of forming and shows a positional relation between a processing tool and a coil portion of a heater.

More specifically, since a relative positional relation among the heaters 4 and 5 and the processing tool 10 is as shown in FIG. 6A, the inclining device 7 swings the heaters 4 and 5 around a swing axis 71 extending in the radial direction of the rotating shaft 21. The swing axis 71 coincides with, for example, a center line of the heat station 6. For example, a rotary table can be used as the inclining device 7.

Figure 2:
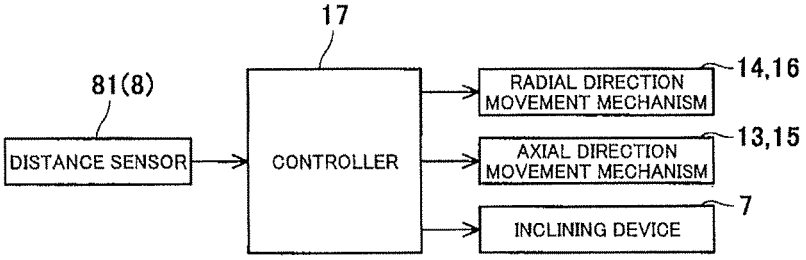
FIG. 2 is a block diagram of the spinning forming device shown in FIG. 1.

The movement mechanisms 13 and 14 for the processing tool 10, the movement mechanisms 15 and 16 for the heaters 4 and 5, and the inclining device 7 are controlled by a controller 17 shown in FIG. 2. The controller 17 prestores a program for forming the plate 9 into a desired shape. The controller 17 controls the movement mechanisms 13 and 14 in accordance with the program to operate the processing tool 10.

In the present embodiment, as shown in FIGS. 3 and 4, two distance sensors 81 each of which measures a distance to the transform target portion 92 of the plate 9 are attached to the front-side heater 5 by a bracket 85. The two distance sensors 81 are disposed so as to be spaced apart from each other in the circumferential direction of the rotating shaft 21. At the same time when the controller 17 operates the processing tool 10, the controller 17 controls the movement mechanisms 15 and 16 such that the distances measured by the distance sensors 81 become constant. Thus, the controller 17 causes the heaters 4 and 5 to follow the processing tool 10. It should be noted that the distance sensors 81 may be attached to the rear-side heater 4.

More specifically, in a plan view, the distance sensors 81 are disposed on a center line of the coil portion 54 so as to sandwich the coil portion 54 (in other words, the distance sensors 81 are disposed at both respective sides of the coil portion 54). The bracket 85 includes: a post 86 standing on the supporting plate 50; and arms 87 each extending from the post 86 to the distance sensor 81.

By the above-described configuration, the relative positions of the distance sensors 81 and the coil portion 54 never change. To be specific, the distance sensors 81 also serve as a measuring unit 8 that measures distances each from the coil portion 54 to an outer peripheral original portion 93 of the plate 9 at a plurality of (in the present embodiment, two) measurement points distributed in the circumferential direction of the rotating shaft 21. The outer peripheral original portion 93 includes the transform target portion 92.

The controller 17 controls the inclining device 7 based on measurement results of the distance sensors 81 such that an angle difference between the coil portion 54 and the outer peripheral original portion 93 becomes not more than a predetermined angle (five degrees, for example). Specifically, the controller 17 controls the inclining device 7 such that an absolute value of a difference between the distances measured at the plurality of measurement points becomes not more than a threshold. For example, the controller 17 controls the inclining device 7 so as to satisfy the following formula where A denotes a distance that is measured by one of the distance sensors 81 and is from one end of the coil portion 54 to the outer peripheral original portion 93, B denotes a distance that is measured by the other distance sensor 81 and is from the other end of the coil portion 54 to the outer peripheral original portion 93, and $\alpha$ denotes the threshold.

$$|A-B|\leq\alpha$$

The measuring unit 8 does not necessarily have to be constituted by a plurality of distance sensors 81. For example, an imaging system including a camera and an image processor may be used as the measuring unit 8, and distances at a plurality of measurement points may be measured by image processing.

Figure 6B:
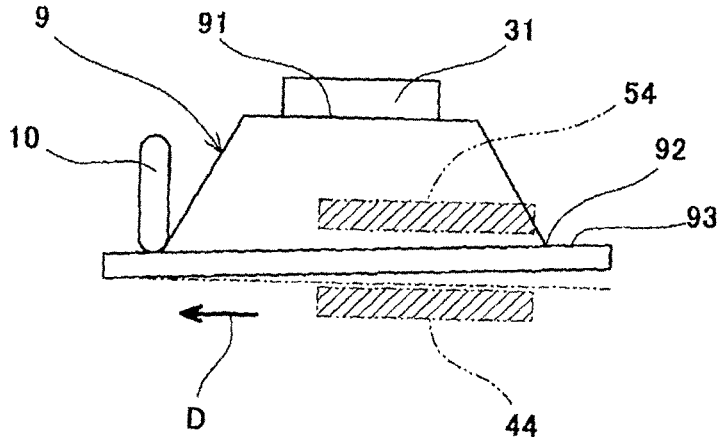
FIG. 6B is a side view of the plate in the middle of the forming and shows a state where the outer peripheral original portion is inclined.

As explained above, according to the spinning forming device 1 of the present embodiment, the distance from the coil portion 44, 54 of the heater 4, 5 to the outer peripheral original portion 93 of the plate 9 can be kept substantially constant. As a result, even when the outer peripheral original portion 93 is inclined as shown in FIG. 6B, the positional relation between the outer peripheral original portion 93 and the coil portion 44, 54 can be appropriately maintained.

Other Embodiments

The present invention is not limited to the above embodiment, and various modifications may be made within the scope of the present invention.

Figure 7A:
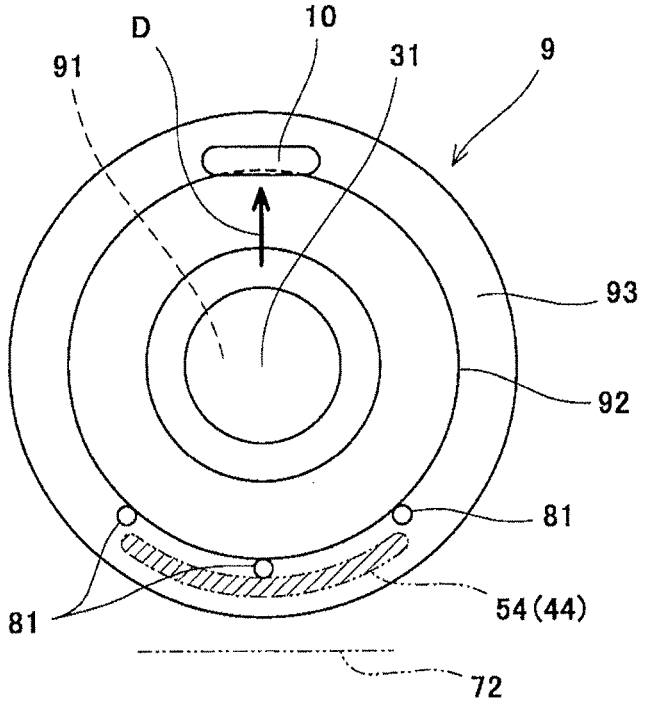
FIG. 7A is a plan view of the plate in the middle of the forming and shows a positional relation between the processing tool and the coil portion of the heater in Modified Example.
Figure 7B:
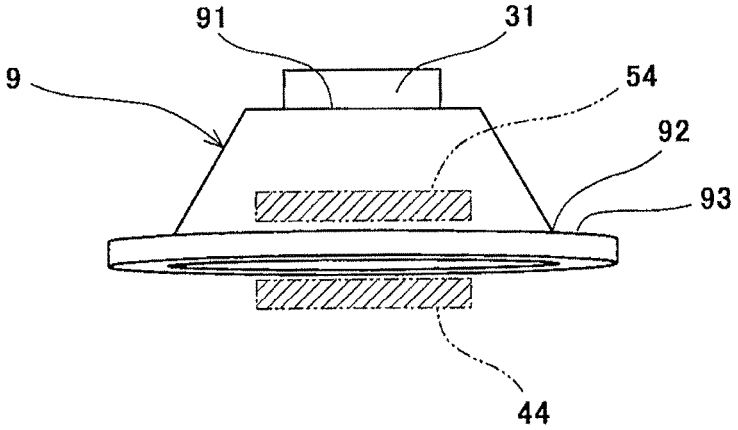
FIG. 7B is a side view of the plate in the middle of the forming and shows a state where the outer peripheral original portion is inclined in Modified Example.

For example, as shown in FIGS. 7A and 7B, each of the rear-side heater 4 and the front-side heater 5 may be disposed at the position that is right opposite to the processing tool 10 across the rotating shaft 21 (FIGS. 7A and 7B shows only the coil portions 44 and 54 of the heaters 4 and 5). In this case, the inclining device 7 may swing the heaters 4 and 5 around a swing axis 72 extending in a direction orthogonal to the radial direction of the rotating shaft 21 to incline the heaters 4 and 5 relative to a direction from the rotating shaft 21 toward the processing tool 10.

According to a layout shown in FIGS. 7A and 7B, for example, three distance sensors 81 are disposed so as to be able to measure a distance from one of both ends of the coil portion 54 to the outer peripheral original portion 93, a distance from the other end of the coil portion 54 to the outer peripheral original portion 93, and a distance from a middle of the coil portion 54 to the outer peripheral original portion 93.

Figure 8:
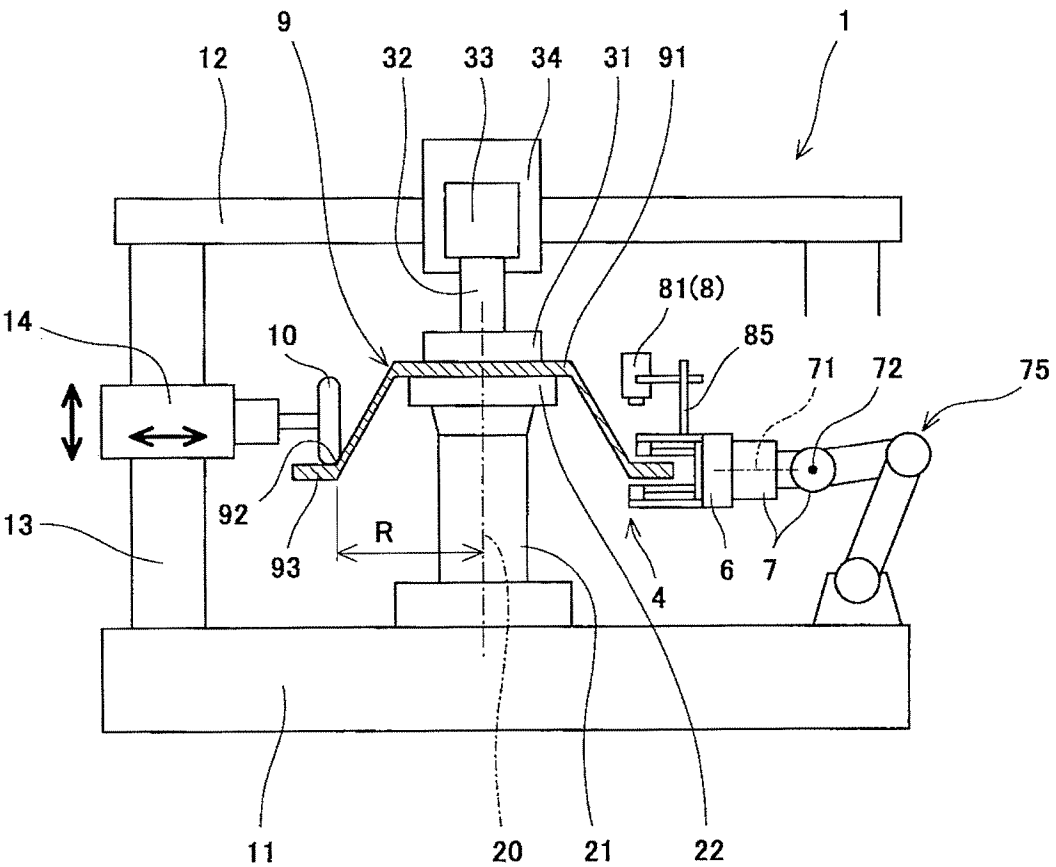
FIG. 8 is a schematic configuration diagram showing the spinning forming device according to another embodiment.

As shown in FIG. 8, the inclining device 7 may serve as one axis of a multi-axis robot 75. For example, when each of the heaters 4 and 5 is disposed at the position displaced from the position that is right opposite to the processing tool 10 across the rotating shaft 21, adopted as the inclining device 7 is a rotating mechanism that is provided between a first (tip end) arm of the multi-axis robot 75 and the heat station 6 and swings the heaters 4 and 5 around the swing axis 71. Or, when each of the heaters 4 and 5 is disposed at the position that is right opposite to the processing tool 10 across the rotating shaft 21, adopted as the inclining device 7 is a rotating mechanism that is provided between the first arm and a second arm of the multi-axis robot 75 and swings the heaters 4 and 5 around the swing axis 72. In this case, the rotating mechanism provided between the first arm and the heat station 6 is unnecessary.

The spinning forming device 1 does not necessarily have to include both the rear-side heater 4 and the front-side heater 5 and may include only one of the rear-side heater 4 and the front-side heater 5. To be specific, the heater of the present invention may be at least one of the rear-side heater 4 and the front-side heater 5.

The inclining device 7 does not necessarily have to incline at least one of the rear-side heater 4 and the front-side heater 5 through the heat station 6. For example, the inclining device 7 may be disposed between the heat station 6 and each of the rear-side heater 4 and the front-side heater 5 so as to be able to individually incline the rear-side heater 4 and the front-side heater 5. In this case, the inclining device 7 may be constituted by: a supporting portion which supports swingably the supporting plate (40 or 50) of the heater (4 or 5); and an actuator (such as an electric-powered cylinder) that drives the supporting plate.

In the above embodiment, the receiving jig 22 is used. However, instead of the receiving jig 22, a mandrel may be adopted. When the mandrel is used, the transform target portion 92 of the plate 9 is pressed against the mandrel by the processing tool 10, so that the inclination of the outer peripheral original portion 93 becomes small. On the other hand, when the receiving jig 22 is used, the transform target portion 92 of the plate 9 is pressed by the processing tool 10 in the air away from the receiving jig 22, so that the inclination of the outer peripheral original portion 93 becomes large. Therefore, the spinning forming device 1 including the receiving jig 22 can remarkably obtain the effects of the present invention.

INDUSTRIAL APPLICABILITY

The present invention is useful when performing spinning forming of plates made of various materials.

REFERENCE SIGNS LIST

1 spinning forming device
10 processing tool
17 controller
21 rotating shaft
22 receiving jig
4 rear-side heater
5 front-side heater
42, 52 coil portion
6 heat station
7 inclining device
8 measuring unit
81 distance sensor
9 plate
91 central portion
92 transform target portion
93 outer peripheral original portion

The invention claimed is:

1. A spinning forming device comprising:

a rotating shaft that rotates a plate to be formed;

a processing tool that presses a transform target portion of the plate to transform the plate;

a heat station having an upper supporting plate configured to be positioned on a front-side of the plate and a lower supporting plate configured to be positioned on a rear-side of the plate;

a front-side heater disposed on the upper supporting plate;

a rear-side heater disposed on the lower supporting plate, the rear-side heater configured to locally heat the transform target portion by induction heating, the rear-side heater including a coil portion extending in a circumferential direction of the rotating shaft and having a doubled circular-arc shape facing the plate;

a measuring unit configured to measure distances each from the coil portion to an outer peripheral original portion of the plate at a plurality of measurement points distributed in the circumferential direction of the rotating shaft, the outer peripheral original portion including the transform target portion;

an inclining device configured to incline the heat station relative to a direction from the rotating shaft toward the processing tool; and a controller configured to control the inclining device based on a measurement result of the measuring unit such that an angle difference between the coil portion and the outer peripheral original portion becomes not more than a predetermined angle.

2. The spinning forming device according to claim 1, wherein:

the heat station is disposed at a position displaced from a position that is opposite to the processing tool across the rotating shaft; and the inclining device is configured to swing the heat station around a swing axis extending in a radial direction of the rotating shaft.

3. The spinning forming device according to claim 1, wherein:

the heat station is disposed at a position that is opposite to the processing tool across the rotating shaft; and the inclining device is configured to swing the heat station around a swing axis extending in a direction orthogonal to a radial direction of the rotating shaft.

4. The spinning forming device according to claim 1, wherein the controller is configured to control the inclining device such that an absolute value of a difference between the distances measured at the plurality of measurement points equal to or less than a threshold value.

5. The spinning forming device according to claim 1, wherein the measuring unit includes a plurality of distance sensors spaced apart from one another in the circumferential direction of the rotating shaft.

6. The spinning forming device according to claim 1, wherein the rear-side heater is disposed at an opposite side of the processing tool across the plate and the front-side heater is disposed at a same side as the processing tool relative to the plate.

7. The spinning forming device according to claim 1, wherein the heat station is coupled to the rear-side heater, an AC power supply circuit is formed in the heat station, and the inclining device is configured to incline the rear-side heater through the heat station.

8. The spinning forming device according to claim 1, further comprising a receiving jig attached to the rotating shaft, the receiving jig supporting a central portion of the plate.

9. The spinning forming device according to claim 1, wherein the measuring unit includes a camera and an image processor.

* * * * *